United States Patent [19]

Beneke et al.

[11] 4,364,151

[45] Dec. 21, 1982

[54] ACCIDENT PREVENTION SYSTEM FOR MACHINES HAVING ONE OR MORE MOVABLE COMPONENTS

[75] Inventors: Wolfgang Beneke; Paul Teichmann, both of Monchen-Gladbach; Wolfgang Schubert, Juchen all of Fed. Rep. of Germany

[73] Assignee: Trützschler GmbH & Co. KG, Monchen-Gladbach, Fed. Rep. of Germany

[21] Appl. No.: 171,821

[22] Filed: Jul. 22, 1980

[51] Int. Cl.[3] ..... D01G 31/00

[52] U.S. Cl. ..... 19/0.2; 19/98; 70/277

[58] Field of Search ..... 19/0.2, 0.21, 98, 99, 19/105, 106 R, 115 R; 70/262, 277

[56] References Cited

U.S. PATENT DOCUMENTS

| | | | |
|---|---|---|---|
| 2,373,411 | 4/1945 | Pierrepont | 19/0.2 X |
| 3,468,143 | 9/1969 | Douglas et al. | 70/277 |
| 4,211,443 | 7/1980 | Butts et al. | 70/277 X |

FOREIGN PATENT DOCUMENTS

| | | |
|---|---|---|
| 7607709 | 3/1976 | Fed. Rep. of Germany . |
| 101218 | 10/1973 | German Democratic Rep. . |
| 596526 | 1/1948 | United Kingdom . |
| 1167720 | 10/1969 | United Kingdom . |

*Primary Examiner*—Louis Rimrodt

*Attorney, Agent, or Firm*—Spencer & Kaye

[57] ABSTRACT

An accident prevention system for machines having one or more movable components, such as rotatable components, has a cover by means of which access may be had to the movable component and which can be moved to an open position. A latching arrangement normally holds the cover in closed position. An electric circuit is provided including a source of electric energy, a normally open switch and an electrically energizable actuating element which can deactivate the latching arrangement. A detector senses movement of the movable component and, when it determines that the movable component is stationary, completes the electric circuit up to the switch so that when the switch is subsequently operated, the actuating element is actuated and disengages the latching arrangement to permit the cover to be opened.

9 Claims, 8 Drawing Figures

ACCIDENT PREVENTION SYSTEM FOR MACHINES HAVING ONE OR MORE MOVABLE COMPONENTS

BACKGROUND OF THE INVENTION

The present invention relates generally to a system for preventing accidents in conjunction with machines, and more particularly to an accident prevention system for machines having one or more movable components.

Many machines, such as textile machines (e.g. carding machines and the like) have components which rotate (e.g. drums, shafts, etc.) or which otherwise move and which therefore can cause an accident if a worker or an observer comes in contact with them. To avoid this, such machines are usually provided with protective casings having doors or other elements which can be opened to afford access to the machine, and in many instances in particular to the movable component of the same. If, however, the door or other element of the casing or protective enclosure can be opened while the movable component continues to move, then the danger of accident is restored, i.e. the protective purpose of the enclosure is defeated. For this reason, proposals have been made to assure that the door of the enclosure can be opened only if the movable component is stationary. For example, in German Gebrauchsmuster DE-GM 76 07 709 a device has been suggested in which the core of an electromagnet is tripped by a sensor which detects if a movable component is stationary, i.e. does not perform any movement. Details of the sensor are not disclosed. Movement of the core causes a switch to be released so that it can be manually operated, whereby at the same time an angled lever is moved which causes the arresting of an actuating element to be deactivated. The actuating element has a projecting part which serves as a hand grip permitting the shifting of a push rod and in response to such shifting latch components connected with the push rod move out of the path of hooks connected with a protective cover so that the same can be opened. In this construction, however, it is necessary to operate two separate elements manually and these elements are, moreover, mechanically linked with one another so that the unlatching of several spaced-apart safety devices—i.e. safety devices on e.g. different machines or machines which are located around a corner from one another—cannot be effected by operating a central switch or the like, or so that at the very least this is possible only by providing a very complicated and therefore expensive construction.

SUMMARY OF THE INVENTION

It is, accordingly, an object of this invention to overcome the disadvantages of the prior art.

A more particular object of the invention is to provide an improved accident-prevention system for machines having one or more movable components, in which the unlatching of a protective cover can be effected by manual operation of only a single element, and can be effected for several machines which may be spaced apart from one another or may even be located around corners from one another.

Another object of the invention is to provide such a system which is uncomplicated and therefore relatively inexpensive to construct.

A concomitant object is to provide a system of the type under discussion which due to its structural simplicity is reliable in operation and not prone to malfunctioning.

In keeping with the above objects, and still others which will become apparent hereafter, one feature of the invention resides, as mentioned before, in an accident-prevention system for machines having at least one movable component. Briefly stated, such a system may comprise cover means movable into and out of a position in which it prevents access to the movable component and latching means for the cover means and being movable to latching and unlatching positions, respectively. Electric circuit means is provided, including a source of electric energy, a normally open switch and an electrically energizable actuating element operatively connected with the latching means for moving the same to the unlatching position thereof. Detecting means is also provided, being operative for sensing movements of the movable component and for completing the circuit means up to the switch means only when no movement of the component is detected, so that operation of the switch subsequent to such completion energizes the actuating element and causes the latching means to be moved to the unlatching position thereof.

In this construction, the actuating element is interposed in the electric circuit and is activated only if the detector has determined that the movable component, for example a rotating drum or shaft, has come to a stationary position. Now, the electric switch can be manually operated causing the actuating element to be moved and to unlatch the latching arrangement so that by manual operation of only a single switch the protective cover is now unlatched and ready to be opened.

A particular advantage of the system according to the present invention resides in the fact that the actuating element is physically separated from the switch, and thus can be located at positions which are far removed from the switch, i.e. at widely spaced different machines or at machines which are located around corners from one another. The switch can be connected with the single or several actuating elements in a simple manner merely by making connections via electrical lines. Furthermore, by utilizing the arrangement according to the present invention, the need for special braking arrangements—i.e. instantaneous brakes which shut down the movement of the movable component when the cover is opened, as is known from the prior art—is no longer necessary so that a further saving in construction costs is obtained.

The detecting means generates an electric current during the movement (e.g. rotation) of the movable components which it supervises. When this component is stationary, no further electrical energy is produced. It is advantageous if the detecting means is a tachometer generator which must be mounted on the rotating or otherwise movable component, for example the rotating shaft of a machine, and in particular on that movable component of the machine which tends to continue moving for the longest period of time (under inertial forces) after the machine has been switched off. This is true both for an individual machine as for a group of machines or an entire installation. Of course, each individual machine can be itself provided with a tachometer generator.

It is also advantageous if the detecting means is connected with the electrical circuit via a voltage dependent relay, for example, a voltage-measuring relay which is controlled by the tachometer generator and influences the electric circuit. It is also advantageous if the tachometer generator is electrically linked with the electric circuit by means of an electronic circuit arrangement.

The actuating element is advantageously electromagnetically controlled and produces a mechanical movement which operates the unlatching mechanism. The actuating element itself may also be a hydraulic or pneumatic cylinder and piston unit which is switched (i.e. operated) via magnetic valves. It is also advantageous in some applications if the actuating element is in form of an electric motor which moves one or more blocking pawls or the like via e.g. a screw spindle or the like. This operation via an electromotor is of particular advantage for chain operations, i.e. where several machines are involved.

In the event that no electric energy is available for activation of the actuating element, e.g., in the event that the external power supply is interrupted, then means may be provided for automatically connecting the actuating element, e.g. the magnetic coil of an electromagnet, to a storage battery or other source of stored electric energy. A separate current supply source e.g. an automatically starting generator, can of course also be used. In this manner, it is possible to unlatch the protective covers even if net voltage has temporarily been interrupted.

According to a currently preferred embodiment the cover, such as the flap, door or the like of the protective enclosure has associated with it an end or limit switch which is electrically connected with the electric drive for the movable component of the machine. This end switch supervises the operation of the movable component, i.e. when the same moves to stationary position and is controlled by the accident prevention system. It is operated when the door or cover has been moved to open position and, in response to such operation, interrupts the electric circuit supplying energy to the movable component of the machine, so as to prevent any accidental energization of the machine while the door or cover is in open position.

It is also advantageous to provide a signal generator which provides an audible and/or visual signal indicating that the protective door or cover has been opened. This makes it possible particularly in the case of an accident prevention system which operates for a number of machines, to indicate at a central location that one or more of the protective covers are open, or at least that the protective covers have been unlatched. Of course, separate indicators for each cover or door can be provided at a central location, so that each individual cover or door can be supervised as to whether or not it is opened or unlatched. The supply of electrical energy by detecting means, e.g. the tachometer generator, is preferably supervised via a sensor which detects whether the motor driving the movable component is energized or not, for example the drive motor for the drum of a carding machine. In the event the tachometer generator should become defective, the electrical circuit in which the actuating element is interposed, can be closed with a delay via a time delay relay.

In principle, it is possible to protect a single machine with a system according to the present invention. However, it will be understood that the system according to the invention can find a particularly advantageous use in groups of machines or an entire installation to be so protected. Furthermore, the system according to the invention makes it possible to protect individual machines within an otherwise protected machine group. It is possible to selectively connect shafts or the like which rotate at different speeds, via tachometer generators to a chain of other similarly protected machines and to supervise them. The central protection of an entire group of machines or installation makes it possible to obtain a structural simplification and to realize cost reductions. The system according to the present invention must, of course, be provided at each door, flap or the like of a protective cover. If only a single switch is used for a machine or an entire installation, then it is advantageous if this switch is located centrally, for example within a central control console or the like.

According to an advantageous embodiment for the central protection of an entire group of machines or installation, a central push button switch supplies electric current via a time delay member to the individual doors, covers or the like, and each electromagnet for the individual doors or covers has a separate push button switch associated with it with which only the electromagnet for the particular door or flap can be operated. This has the advantage that only so much electrical energy is required for operating the electromagnets, as is necessary for unlatching the particular number of doors that is to be opened at any given time.

The invention will hereafter be described with reference to exemplary embodiments. It is to be understood, however, that is by way of description only and is not to be considered limiting in any sense.

DESCRIPTION OF PREFERRED EMBODIMENTS

Figure 1:
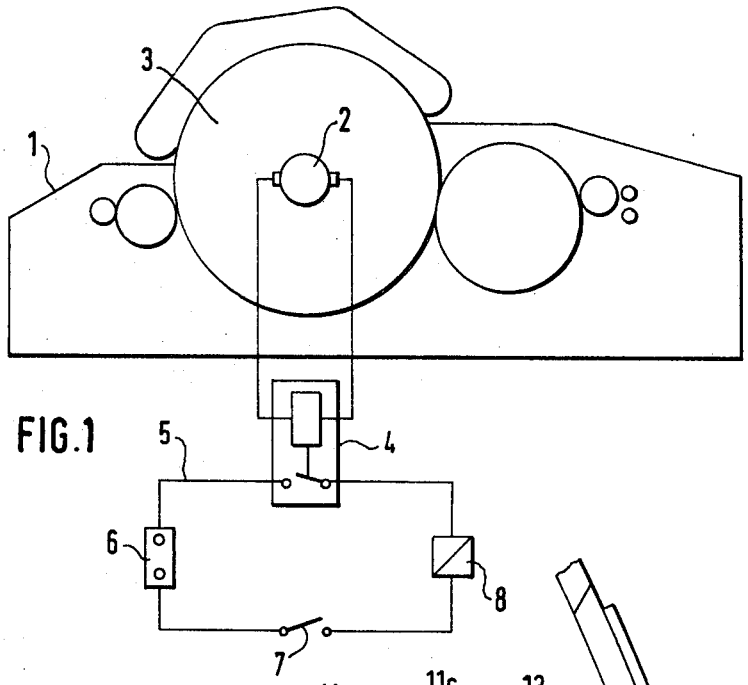
FIG. 1 is a diagrammatic illustration giving an overview of an embodiment of the invention.
Figure 2A:
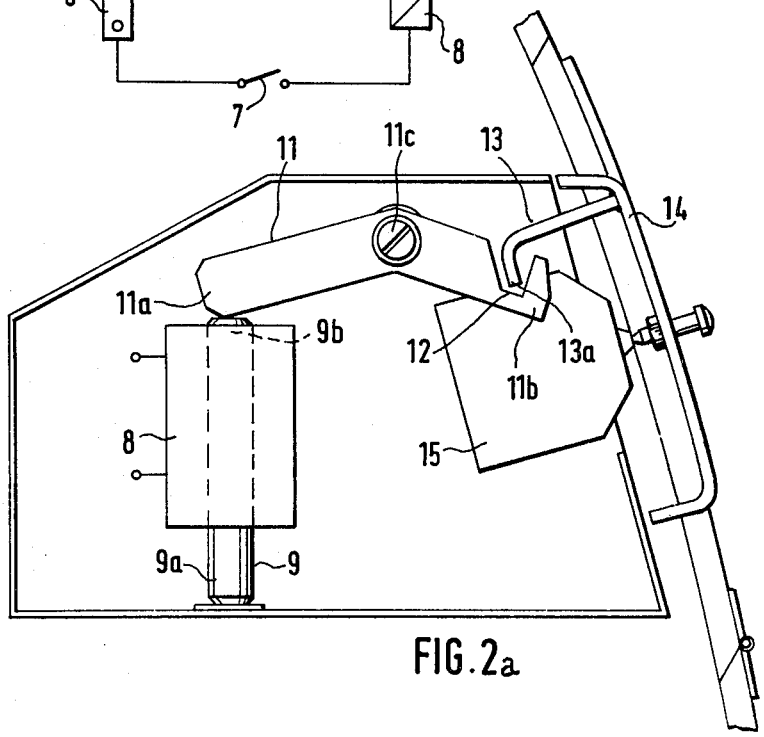
FIG. 2*a* is a detailed view, showing the actuating element in a position in which a movable cover is latched.
Figure 2B:
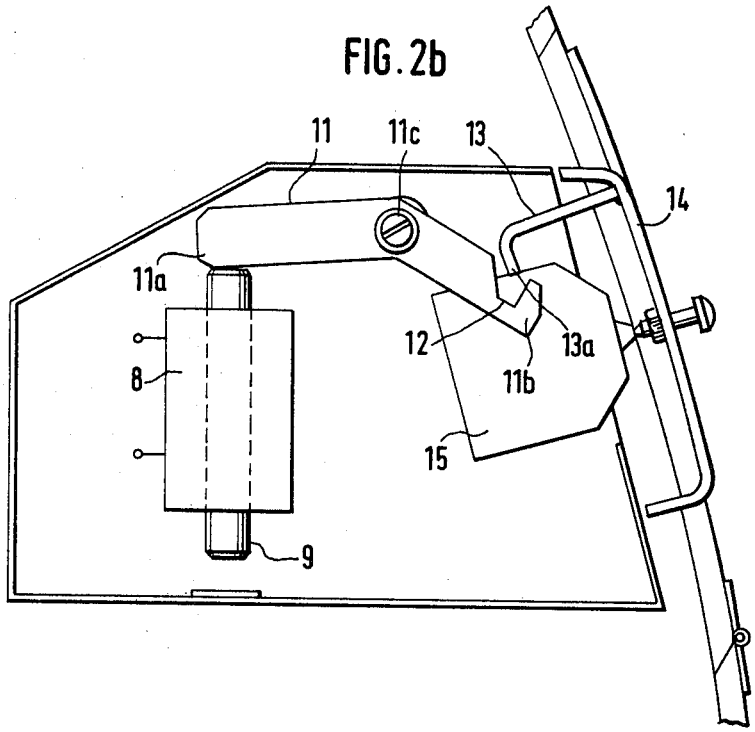
FIG. 2*b* is a view similar to FIG. 2*a*, but showing the cover unlatched.

Referring firstly to FIGS. 1, 2*a* and 2*b*, it will be seen that the invention in this embodiment has been illustrated as employed with reference to a carding machine 1. This carding machine 1 utilizes a tachometer generator 2 (known per se) which acts as a detector or sensor to detect whether the carding drum or roller 3 of the carding machine rotates or is stationary. The tachometer generator 2 is connected via a voltage measuring relay 4 with an electrical circuit in which a voltage supply source 6, a push button switch 7 and an electromagnet 8 are interposed. The core 9 of the electromagnet 8 rests with one end 9*a* on a stationary support. Its other end 9*b* engages the end 11*a* of a double-armed lever 11 which is turnable about a pivot 11*c*. The other end 11*b* of the lever 11 is provided with a cutout or recess 12 into which the angled end 13*a* of a hook 13 engages which is rigidly mounted on a protective cover 14, for example on the output door or flap of the carding machine 1. The inner side of the protective cover 14 has further mounted on it an end or limit switch 15 which is electrically connected with the not illustrated electric drive for the drum 3.

In operation of the system, the tachometer generator 2 produces an electrical current as long as the shaft of the drum 3 on which it is mounted, continues to rotate. When the drum and thus the shaft have become stationary, the tachometer generator 2 no longer produces any electrical energy and as a result the voltage measuring relay 4 becomes activated, which closes the electrical circuit 5 and thus completes it up to the open push button switch 7. If, thereafter, the push button switch 7 is manually operated, the electric circuit 5 is fully completed and this causes the core 9 of the electromagnet 8 to be triggered, i.e. to be raised in FIG. 2*a* by the action of the coil of the electromagnet 8 counter to the influence of gravitational force and to push against the end 11*a* of the lever 11. As a result, the lever 11 is pivoted about the pivot 11*c* and the end portion 13*a* of the hook 13 is released from the cutout 12 of the end ll*b* of lever 11, since the end 11*b* moves downwardly away from the hook 13, as shown in FIG. 2*b*. The door 14 is now unlatched and can be opened. When the door 14 is in fact moved to open position, the limit switch 15 is operated and interrupts the electrical circuit for the drive of the drum 3, thus preventing the drum 3 from becoming accidentally started up while the cover 14 is in open position. It might be mentioned here that the drum 3 may be manually turned in the direction counter to its normal direction of rotation with the door 14 open, so that certain types of operation—for example, certain types of maintenance—can be carried out on it. Only after the door 14 has been closed again and the limit switch reactivated, can the drive for the drum 3 be turned on again.

Figure 3:
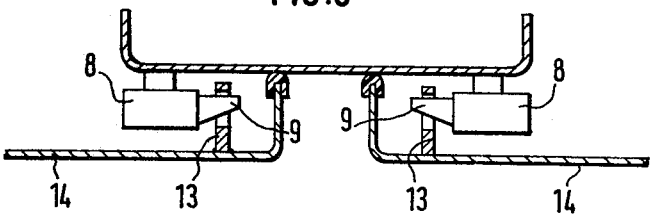
FIG. 3 is a partly sectioned detailed view, illustrating an embodiment in which the core of an electromagnet directly latches or unlatches a door or cover.

A further embodiment of the invention is illustrated in FIG. 3. It is the same as the preceding embodiment with the exception of the specifically different features to be described hereinafter.

In FIG. 3, two electromagnets 8 are provided which serve as the actuating element and which each have a core 9 that respectively engages behind a hook 13 connected rigidly with the door 14. In other words, in this embodiment it is the electromagnets 8 which directly act to latch or unlatch the door, without the interposition of an element such as the lever 11. When the electromagnets 8 are energized, the cores 9 thereof are retracted in these embodiments, rather than being extended as in FIGS. 2*a* and 2*b*, so that the hooks 13 are disengaged and the door 14 can then be opened.

Figure 4A:
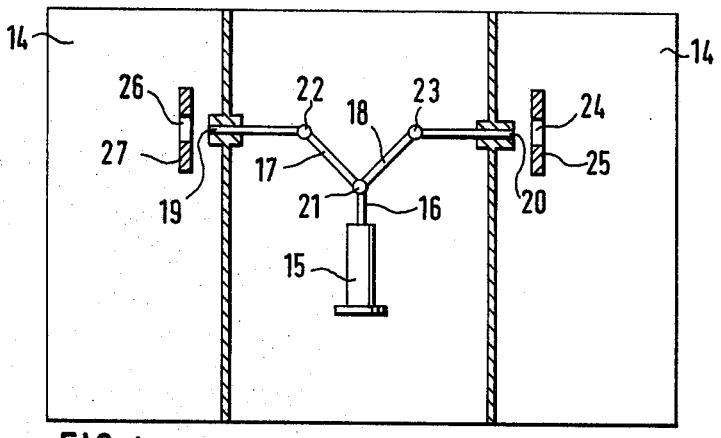
FIGS. 4*a* and 4*b* are partly sectioned detail views, illustrating an embodiment in which a pneumatic cylinder is utilized as an actuating element.
Figure 4B:
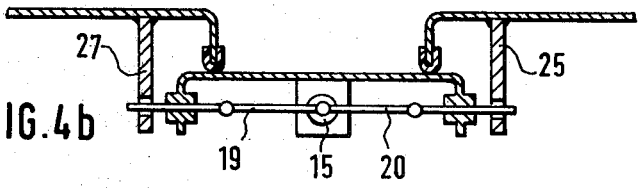

In the embodiment of FIGS. 4*a* and 4*b* the actuating element is formed by a pneumatic cylinder 15 (it could also be a hydraulic cylinder) which is switched to extend or retract its piston by not illustrated magnetic valves. Such magnetic valves are known per se and require no discussion. The cylinder 15 has a piston rod 16 which is linked with two rods 19 and 20 via rods 17,18 and joints 21, 22 and 23. The rods 19,20 engage in openings 24,26 of two lugs or eyes 25 and 27 which in turn are rigidly connected with the respective door 14. The device is shown in unlatched condition in FIG. 4*a* and in latched condition in FIG. 4*b*.

Figure 5:
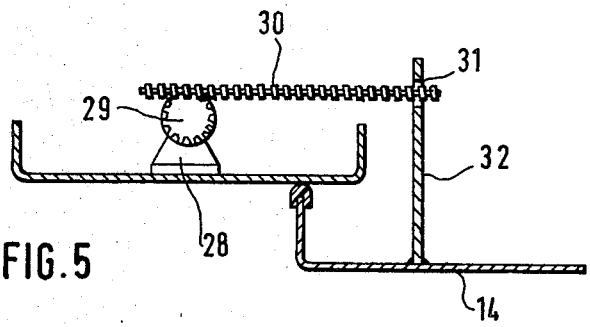
FIG. 5 is a partly sectioned detailed view, illustrating an embodiment in which an electromotor with a spindle is utilized as an actuating element.

In FIG. 5 the actuating element is constituted by an electric motor 28 which drives via a worm gear 29 a screw spindle 30, one end of which engages in the opening 31 of a hook 32 which is again rigidly connected with the door 14. Depending upon the direction of rotation of the motor 28 (the motor of course is direction-reversible) the spindle 30 moves into or out of the opening 31 to latch or unlatch the door 14.

Figure 6:
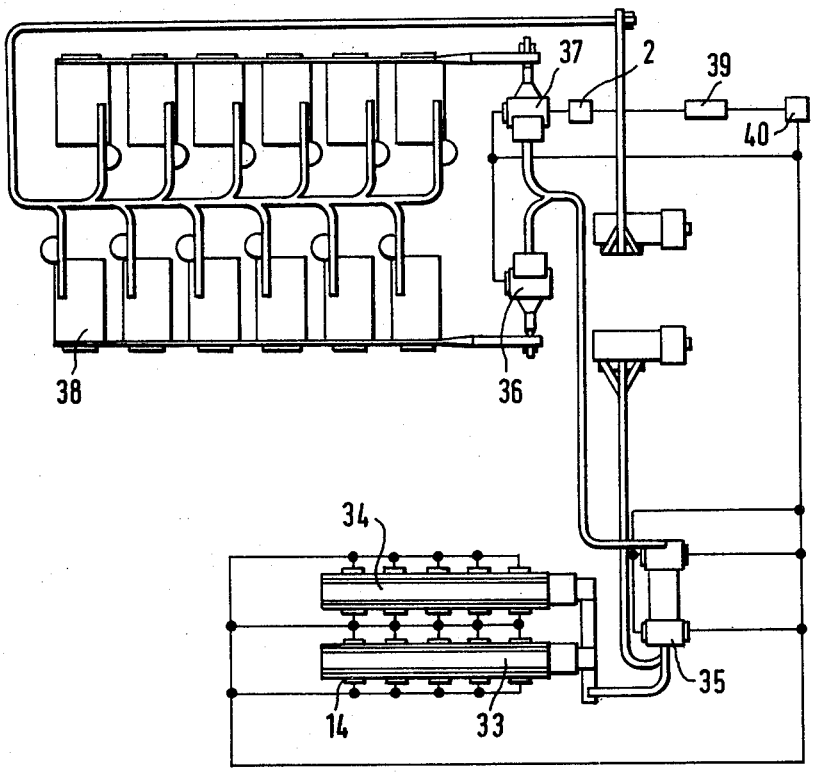
FIG. 6 is a somewhat diagrammatic illustration, showing the protection of an entire machine group by means of a system according to the present invention.

FIG. 6, finally, shows how an entire group composed of several machines can be centrally protected with a system according to the present invention. This group of machines is composed of two bale-opening machines 33,34, i.e. machines which open up compressed bales of fibers. Following these is a cleaning device 35 which is associated with two fine-opening devices 36,37 (i.e. devices that complete the opening-up action on the fibers) from where the fibers are forwarded to several carding machines 38. A component of the opener 37 has associated with it a tachometer generator 2 which is electrically connected with a centrally arranged control stand or panel 39 that is provided, inter alia, with the push button switch for the electric circuit. Each door to be protected, for example the door 40 on the opener 33, is provided with an actuating element of one of the types described with reference to FIGS. 1–5. These respective actuating elements are connected via electrical lines with the control panel 39 the component of the opener 37 which is provided with the tachometer generator 2, is that element in the entire group of machines which tends to continue moving the longest under the influence of inertia once the machines have been shut down. Only a single push button switch is provided for the entire group of machines and is, as mentioned before, located centrally at the control panel 39. By operating it, all electromagnets serving for unlatching are energized via a time delay element (known per se) and are maintained in energized condition until the preset time has expired at which point they become deenergized again. This time is so selected that an operator can within this time manage to reach the farthest located door 40 and to open it. Of course, all doors may advantageously be maintained in closed position (but not latched against intentional opening) by a magnetic latch or the like so that they cannot fall open by themselves when their latching devices have been deactivated.

The invention has hereinbefore been illustrated with reference to several exemplary embodiments. It will be understood, however, that various changes and modifications will offer themselves to those skilled in the art and, therefore, all such changes and modifications are intended to be encompassed within the protection of the appended claims.

We claim:

1. In a safety locking system for preventing access to a movable component of a machine during operation thereof, said machine having a cover arranged to assume an open position to permit access to said movable component and a closed position to block access to said movable component; the combination comprising (a) latching means cooperating with said cover and arranged to assume a latching position preventing said cover from being moved from said closed position to said open position and an unlatching position allowing said cover to be moved from said closed position to said open position;

(b) an electrically energizable actuating element operatively connected with said latching means for setting said latching means from said latching position to said unlatching position upon energization of said actuating element;

(c) an electric energizing circuit connected to said actuating element; said circuit including in series
(1) a voltage source;
(2) a first circuit breaker forming part of a relay and having an open position as long as said relay is energized and a closed position as long as said relay is de-energized;
(3) an arbitrarily operable, normally open second circuit breaker; and (d) motion detecting means operatively connected with said movable component; said motion detecting means having an output connected to said relay for maintaining said relay energized as long as said movable component is in motion and for maintaining said relay de-energized as long as said movable component is at a standstill, whereby said latching means is set into said unlatching position solely during standstill of said movable component and a simultaneous closing of said arbitrarily operable, normally open second circuit breaker.

2. A combination as defined in claim 1, wherein said motion detecting means comprises a tachometer generator driven by the movement of said component.

3. A combination as defined in claim 1, said second circuit breaker being a push button switch.

4. A combination as defined in claim 1, said actuating element being a fluid-operated cylinder and piston unit including magnetic fluid control valves.

5. A combination as defined in claim 1, said actuating element being an electric motor and a mechanism driven by said motor and linked with said latching means.

6. A combination as defined in claim 1, said latching means comprising an engaging portion on said cover and a double-armed lever having spaced ends and being pivoted intermediate said ends, one of said ends being in engagement with said engaging portion in said latching position and said actuating element, when energized, acting upon the other of said ends to pivot said lever for disengaging said one end from said engaging portion, whereby said latching means is set into said unlatching position.

7. A combination as defined in claim 1, wherein the movable component is provided with an electrically energized drive; and further comprising limit switch means operatively associated with said cover and in circuit with said drive for deactivating the drive when said cover moves out of said closed position thereof.

8. A combination as defined in claim 1, further comprising signal generating means for generating a signal in response to movement of said cover out of said closed position thereof.

9. A combination as defined in claim 8, said signal generating means comprising an optical and/or an acoustic signal generator.

* * * * *